US008075372B2

(12) United States Patent
Prasad

(10) Patent No.: US 8,075,372 B2
(45) Date of Patent: Dec. 13, 2011

(54) POLISHING PAD WITH MICROPOROUS REGIONS

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 1529 days.

(21) Appl. No.: 10/931,908

(22) Filed: Sep. 1, 2004

(65) Prior Publication Data

US 2006/0046622 A1 Mar. 2, 2006

(51) Int. Cl.
*B24B 1/00* (2006.01)
*B24D 11/00* (2006.01)

(52) U.S. Cl. ..... 451/59; 51/298; 451/527; 451/529; 451/550

(58) Field of Classification Search ..... 451/41, 451/530, 526–528, 534, 533, 537, 538, 921, 451/59, 63, 529, 550; 51/298, 307, 308, 51/309

See application file for complete search history.

(56) References Cited

U.S. PATENT DOCUMENTS 3,504,457 A 4/1970 Jacobsen et al.
3,581,439 A 6/1971 Jensen et al.
4,138,228 A 2/1979 Hartfelt et al.
4,239,567 A 12/1980 Winings
4,519,909 A * 5/1985 Castro ..... 210/500.27
4,753,838 A 6/1988 Kimura et al.
4,954,141 A * 9/1990 Takiyama et al. ..... 51/296
5,182,307 A 1/1993 Kumar
5,197,999 A * 3/1993 Thomas ..... 51/298
5,257,478 A 11/1993 Hyde et al.
5,433,651 A 7/1995 Lustig et al.
5,489,233 A 2/1996 Cook et al.
5,605,760 A 2/1997 Roberts
5,609,517 A 3/1997 Lofaro
5,628,862 A 5/1997 Yu et al.
5,684,055 A 11/1997 Kumar et al.
5,879,222 A * 3/1999 Robinson ..... 451/41
5,893,796 A 4/1999 Birang et al.
5,944,583 A 8/1999 Cruz et al.
5,964,643 A 10/1999 Birang et al.
6,007,407 A 12/1999 Rutherford et al.
6,017,265 A * 1/2000 Cook et al. ..... 451/41
6,022,268 A 2/2000 Roberts et al.
6,045,439 A 4/2000 Birang et al.
6,062,968 A * 5/2000 Sevilla et al. ..... 451/526
6,089,963 A 7/2000 Wiand et al.
6,089,965 A * 7/2000 Otawa et al. ..... 451/527
6,117,000 A 9/2000 Anjur et al.
6,120,353 A 9/2000 Suzuki et al.
6,126,532 A * 10/2000 Sevilla et al. ..... 451/526
6,146,242 A 11/2000 Treur et al.
6,168,508 B1 * 1/2001 Nagahara et al. ..... 451/527
6,169,122 B1 1/2001 Blizard et al.
6,171,181 B1 1/2001 Roberts et al.
6,231,434 B1 * 5/2001 Cook et al. ..... 451/527
6,231,942 B1 5/2001 Blizard et al.
6,235,380 B1 5/2001 Tupil et al.
6,238,271 B1 * 5/2001 Cesna ..... 451/41
6,245,406 B1 6/2001 Kuramochi et al.
6,248,000 B1 6/2001 Aiyer
6,261,155 B1 7/2001 Jairath et al.
6,284,810 B1 9/2001 Burnham et al.
6,290,883 B1 * 9/2001 Crevasse et al. ..... 264/50
6,315,645 B1 11/2001 Zhang et al.
6,328,642 B1 12/2001 Pant et al.
6,328,644 B1 12/2001 Kuramochi et al.
6,358,130 B1 3/2002 Freeman et al.
6,368,200 B1 4/2002 Merchant et al.
6,387,312 B1 5/2002 Roberts et al.
6,425,816 B1 7/2002 Roberts et al.
6,428,586 B1 8/2002 Yancey
6,435,947 B2 8/2002 Mueller et al.
6,454,634 B1 * 9/2002 James et al. ..... 451/41
6,458,023 B1 10/2002 Moon
6,477,926 B1 * 11/2002 Swisher et al. ..... 451/526
6,530,829 B1 * 3/2003 Kramer ..... 451/527
6,537,134 B2 * 3/2003 Newell ..... 451/6
6,561,891 B2 * 5/2003 Eppert, Jr. et al. ..... 451/530
6,626,740 B2 9/2003 Baker, III et al.
6,641,471 B1 11/2003 Pinheiro et al.
6,685,540 B2 * 2/2004 Cherian et al. ..... 451/41
6,905,402 B2 * 6/2005 Allison et al. ..... 451/533

(Continued)

FOREIGN PATENT DOCUMENTS

EP 0 239 040 A1 9/1987

(Continued)

*Primary Examiner* — Timothy V Eley
(74) *Attorney, Agent, or Firm* — Thomas E. Omholt; Caryn Borg-Breen; Steven D. Weseman

(57) ABSTRACT

The invention provides a polishing pad for chemical-mechanical polishing comprising a polymeric material comprising two or more adjacent regions, wherein the regions have the same polymer formulation and the transition between the regions does not include a structurally distinct boundary. In a first embodiment, a first region and a second adjacent region have a first and second non-zero void volume, respectively, wherein the first void volume is less than the second void volume. In a second embodiment, a first non-porous region is adjacent to a second adjacent porous region, wherein the second region has an average pore size of about 50 μm or less. In a third embodiment, at least two of an optically transmissive region, a first porous region, and an optional second porous region, are adjacent. The invention further provides methods of polishing a substrate comprising the use of the polishing pads and a method of producing the polishing pads.

37 Claims, No Drawings

U.S. PATENT DOCUMENTS

| | | | | |
|---|---|---|---|---|
| 6,913,517 | B2 * | 7/2005 | Prasad | 451/41 |
| 7,101,501 | B2 * | 9/2006 | Shih et al. | 264/51 |
| 2001/0018121 | A1 | 8/2001 | Okamoto et al. | |
| 2001/0033040 | A1 | 10/2001 | Cardona et al. | |
| 2001/0053658 | A1 | 12/2001 | Budinger et al. | |
| 2002/0010232 | A1 | 1/2002 | Ogawa et al. | |
| 2002/0016146 | A1 | 2/2002 | Kuramochi et al. | |
| 2002/0072296 | A1 | 6/2002 | Muilenburg et al. | |
| 2002/0098790 | A1 * | 7/2002 | Burke | 451/528 |
| 2002/0111120 | A1 | 8/2002 | Goetz | |
| 2002/0123300 | A1 | 9/2002 | Jones et al. | |
| 2003/0060151 | A1 | 3/2003 | Kramer | |
| 2003/0194959 | A1 * | 10/2003 | Grumbine et al. | 451/288 |
| 2004/0102137 | A1 * | 5/2004 | Allison et al. | 451/28 |
| 2005/0026552 | A1 * | 2/2005 | Fawcett et al. | 451/41 |

FOREIGN PATENT DOCUMENTS

| | | | |
|---|---|---|---|
| EP | 0 304 645 | A2 | 3/1989 |
| EP | 1 046 466 | A2 | 10/2000 |
| EP | 1 108 500 | A1 | 6/2001 |
| EP | 1 211 024 | A2 | 6/2002 |
| WO | WO 98/14304 | A1 | 4/1998 |
| WO | WO 98/28108 | A1 | 7/1998 |
| WO | WO 00/12264 | A1 | 3/2000 |
| WO | WO 00/26005 | A1 | 5/2000 |
| WO | WO 00/59702 | A1 | 10/2000 |
| WO | WO 01/15863 | A1 | 3/2001 |
| WO | WO 01/15885 | A1 | 3/2001 |
| WO | WO 01/36521 | A2 | 5/2001 |
| WO | WO 01/94074 | A1 | 12/2001 |
| WO | WO 02/02274 | A2 | 1/2002 |
| WO | WO 02/09907 | A1 | 2/2002 |

* cited by examiner

POLISHING PAD WITH MICROPOROUS REGIONS

FIELD OF THE INVENTION

This invention pertains to a polishing pad for chemical-mechanical polishing.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

Polishing pads used in chemical-mechanical polishing processes are manufactured using both soft and rigid pad materials, which include polymer-impregnated fabrics, microporous films, cellular polymer foams, non-porous polymer sheets, and sintered thermoplastic particles. A pad containing a polyurethane resin impregnated into a polyester non-woven fabric is illustrative of a polymer-impregnated fabric polishing pad. Microporous polishing pads include microporous urethane films coated onto a base material, which is often an impregnated fabric pad. These polishing pads are closed cell, porous films. Cellular polymer foam polishing pads contain a closed cell structure that is randomly and uniformly distributed in all three dimensions. Non-porous polymer sheet polishing pads include a polishing surface made from solid polymer sheets, which have no intrinsic ability to transport slurry particles (see, for example, U.S. Pat. No. 5,489,233). These solid polishing pads are externally modified with large and/or small grooves that are cut into the surface of the pad purportedly to provide channels for the passage of slurry during chemical-mechanical polishing. Such a non-porous polymer polishing pad is disclosed in U.S. Pat. No. 6,203,407, wherein the polishing surface of the polishing pad comprises grooves that are oriented in such a way that purportedly improves selectivity in the chemical-mechanical polishing. Also in a similar fashion, U.S. Pat. Nos. 6,022,268, 6,217,434, and 6,287,185 disclose hydrophilic polishing pads with no intrinsic ability to absorb or transport slurry particles. The polishing surface purportedly has a random surface topography including microasperities that have a dimension of 10 μm or less and are formed by solidifying the polishing surface and macro defects (or macrotexture) that have a dimension of 25 μm or greater and are formed by cutting. Sintered polishing pads comprising a porous open-celled structure can be prepared from thermoplastic polymer resins. For example, U.S. Pat. Nos. 6,062,968 and 6,126,532 disclose polishing pads with open-celled, microporous substrates, produced by sintering thermoplastic resins. The resulting polishing pads preferably have a void volume between 25 and 50% and a density of 0.7 to 0.9 g/cm$^3$. Similarly, U.S. Pat. Nos. 6,017,265, 6,106,754, and 6,231,434 disclose polishing pads with uniform, continuously interconnected pore structures, produced by sintering thermoplastic polymers at high pressures in excess of 689.5 kPa (100 psi) in a mold having the desired final pad dimensions.

In addition to groove patterns, polishing pads can have other surface features to provide texture to the surface of the polishing pad. For example, U.S. Pat. No. 5,609,517 discloses a composite polishing pad comprising a support layer, nodes, and an upper layer, all with different hardness. U.S. Pat. No. 5,944,583 discloses a composite polishing pad having circumferential rings of alternating compressibility. U.S. Pat. No. 6,168,508 discloses a polishing pad having a first polishing area with a first value of a physical property (e.g., hardness, specific gravity, compressibility, abrasiveness, height, etc.) and a second polishing area with a second value of the physical property. U.S. Pat. No. 6,287,185 discloses a polishing pad having a surface topography produced by a thermoforming process. The surface of the polishing pad is heated under pressure or stress resulting in the formation of surface features. U.S. patent application Publication 2003/0060151 A1 discloses a polishing pad having isolated regions of continuous void volume, which are separated by a non-porous matrix.

Polishing pads having a microporous foam structure are commonly known in the art. For example, U.S. Pat. No. 4,138,228 discloses a polishing article that is microporous and hydrophilic. U.S. Pat. No. 4,239,567 discloses a flat microcellular polyurethane polishing pad for polishing silicon wafers. U.S. Pat. No. 6,120,353 discloses a polishing method using a suede-like foam polyurethane polishing pad having a compressibility lower than 9% and a high pore density of 150 pores/cm$^2$ or higher. EP 1 108 500 A1 discloses a polishing pad of micro-rubber A-type hardness of at least 80 having closed cells of average diameter less than 1000 μm and a density of 0.4 to 1.1 g/ml.

Although several of the above-described polishing pads are suitable for their intended purpose, a need remains for other polishing pads that provide effective planarization, particularly in the chemical-mechanical polishing of a substrate. In addition, there is a need for polishing pads having satisfactory features such as polishing efficiency, slurry flow across and within the polishing pad, resistance to corrosive etchants, and/or polishing uniformity. Finally, there is a need for polishing pads that can be produced using relatively low cost methods and which require little or no conditioning prior to use.

The invention provides such a polishing pad. These and other advantages of the invention, as well as additional inventive features, will be apparent from the description of the invention provided herein.

BRIEF SUMMARY OF THE INVENTION

The invention provides a polishing pad for chemical-mechanical polishing comprising a porous polymeric material comprising a first region having a first void volume and a second adjacent region having a second void volume, wherein the first void volume and second void volume are non-zero, the first void volume is less than the second void volume, the first region and second region have the same polymer formulation, and the transition between the first and second region does not include a structurally distinct boundary. The invention further provides a polishing pad comprising a polymeric material comprising a first non-porous region and a second porous region adjacent to the first non-porous region, wherein the second region has an average pore size of about 50 μm or less, the first region and second regions have the same polymer formulation, and the transition between the first and second region does not include a structurally distinct boundary. The invention further provides a polishing pad comprising a polymeric material comprising (a) an optically transmissive region, (b) a first porous region, and optionally (c) a second porous region, wherein at least two regions selected from the optically transmissive region, first porous region, and second porous region, if present, have the same polymer formulation and have a transition that does not include a structurally distinct boundary.

The invention further provides a method of polishing a substrate comprising (a) providing a substrate to be polished, (b) contacting the substrate with a polishing system comprising a polishing pad of the invention and a polishing composition, and (c) abrading at least a portion of the substrate with the polishing system to polish the substrate.

The invention also provides a method of producing a polishing pad of the invention comprising (i) providing a polishing pad material comprising a polymer resin and having a first void volume, (ii) covering one or more portions of the polishing pad material with a secondary material having a desired shape or pattern, (iii) subjecting the polishing pad material to a supercritical gas at an elevated pressure, (iv) foaming the uncovered portions of the polishing pad material by subjecting the polishing pad material to a temperature above the glass transition temperature ($T_g$) of the polishing pad material, and (v) removing the secondary material so as to reveal the covered portions, wherein the uncovered portions of the polishing pad material have a second void volume that is greater than the first void volume.

DETAILED DESCRIPTION OF THE INVENTION

The invention is directed to a polishing pad for chemical-mechanical polishing comprising a polymeric material comprising two or more adjacent regions, wherein the regions have the same polymer formulation and the transition between the regions does not include a structurally distinct boundary.

In a first embodiment, the first and second regions are porous. The polymeric material comprises a first region having a first void volume and a second adjacent region having a second void volume. The first void volume and second void volume are each non-zero (i.e., greater than zero). The first void volume is less than the second void volume. The first and second regions of the polishing pad can have any suitable non-zero void volume. For example, the void volume of the first and second regions can be about 5% to about 80% (e.g., about 10% to about 75%, or about 15% to about 70%) of the volume of the respective regions. Preferably, the void volume of the first region is about 5% to about 50% (e.g., about 10% to about 40%) of the volume of the first region. Preferably, the void volume of the second region is about 20% to about 80% (e.g., about 25% to about 75%) of the volume of the second region.

The first and second regions of the polishing pad can have any suitable volume. For example, the volume of each of the first and second regions typically is about 5% or more of the total volume of the polishing pad. Preferably, the volume of each of the first and second regions is about 10% or more (e.g., about 15% or more) of the total volume of the polishing pad. The first and second regions can have the same volume or a different volume. Typically, the first and second regions will have a different volume.

The first and second regions of the polishing pad can have any suitable average pore size. For example, the first or second region can have an average pore size of about 500 μm or less (e.g., about 300 μm or less, or about 200 μm or less). In one preferred embodiment, the first or second region has an average pore size of about 50 μm or less (e.g., about 40 μm or less, or about 30 μm or less). In another preferred embodiment, the first or second region has an average pore size of about 1 μm to about 20 μm (e.g., about 1 μm to about 15 μm, or about 1 μm to about 10 μm). In yet another preferred embodiment, the first region has an average pore size of about 50 μm or less, and the second region has an average pore size of about 1 μm to about 20 μm.

The first and second regions of the polishing pad can have any suitable pore size (i.e., cell size) distribution. Typically about 20% or more (e.g., about 30% or more, about 40% or more, or about 50% or more) of the pores (i.e., cells) in the first or second regions have a pore size distribution of about ±100 μm or less (e.g., about ±50 μm or less) of the average pore size. Preferably the first or second region has a highly uniform distribution of pore sizes. For example, about 75% or more (e.g., about 80% or more, or about 85% or more) of the pores in the first or second region have a pore size distribution of about ±20 μm or less (e.g., about ±10 μm or less, about ±5 μm or less, or about ±2 μm or less) of the average pore size. In other words, about 75% or more (e.g., about 80% or more, or about 85% or more) of the pores in the first or second region have a pore size within about 20 μm or less (e.g., about ±10 μm or less, about ±5 μm or less, or about ±2 μm or less) of the average pore size. Preferably, about 90% or more (e.g., about 93% or more, about 95% or more, or about 97% or more) of the pores in the first or second region have a pore size distribution of about ±20 μm or less (e.g., about ±10 μm or less, about ±5 μm or less, or about ±2 μm or less) of the average pore size.

The first and second regions can have a uniform or a non-uniform distribution of pores. In some embodiments, the first region has a uniform distribution of pores and the second region has a less uniform distribution of pores, or a non-uniform distribution of pores. In a preferred embodiment, about 75% or more (e.g., about 80% or more, or about 85% or more) of the pores in the first region have a pore size within about ±20 μm or less (e.g., about ±10 μm or less, about ±5 μm or less, or about ±2 μm or less) of the average pore size, and about 50% or less (e.g., about 40% or less, or about 30% or less) of the pores in the second region have a pore size within about 20 μm or less (e.g., about ±10 μm or less, about ±5 μm or less, or about ±2 μm or less) of the average pore size.

Additionally, the first or second region of the polishing pad can have a multi-modal distribution of pores. The term "multi-modal" means that the porous region has a pore size distribution comprising at least 2 or more (e.g., about 3 or more, about 5 or more, or even about 10 or more) pore size maxima. Typically the number of pore size maxima is about 20 or less (e.g., about 15 or less). A pore size maximum is defined as a peak in the pore size distribution whose area comprises about 5% or more by number of the total number of pores. Preferably, the pore size distribution is bimodal (i.e., has two pore size maxima).

The multi-modal pore size distribution can have pore size maxima at any suitable pore size values. For example, the multi-modal pore size distribution can have a first pore size maximum of about 50 μm or less (e.g., about 40 μm or less, about 30 μm or less, or about 20 μm or less) and a second pore size maximum of about 50 μm or more (e.g., about 70 μm or more, about 90 μm or more, or even about 120 μm or more). The multi-modal pore size distribution alternatively can have a first pore size maximum of about 20 μm or less (e.g., about 10 μm or less, or about 5 μm or less) and a second pore size maximum of about 20 μm or more (e.g., about 35 μm or more, about 50 μm or more, or even about 75 μm or more).

Typically the first or second region comprises predominantly closed cells (i.e., pores); however, the first or second region can also comprise open cells. Preferably, the first or second region comprises about 5% or more (e.g., about 10% or more) closed cells based on the total void volume. More preferably, the first or second region comprises about 20% or more (e.g., about 30% or more, about 40% or more, or about 50% or more) closed cells.

The first or second region typically has a density of about 0.5 g/cm$^3$ or greater (e.g., about 0.7 g/cm$^3$ or greater, or even about 0.9 g/cm$^3$ or greater) and a void volume of about 25% or less (e.g., about 15% or less, or even about 5% or less). Typically the first or second region has a cell density of about $10^5$ cells/cm$^3$ or greater (e.g., about $10^6$ cells/cm$^3$ or greater). The cell density can be determined by analyzing a cross-sectional image (e.g., an SEM image) of a first or second region with an image analysis software program such as Optimas® imaging software and ImagePro® imaging software, both by Media Cybernetics, or Clemex Vision® imaging software by Clemex Technologies.

The first and second regions typically will have a different compressibility. The compressibility of the first and second region will depend, at least in part, on the void volume, average pore size, pore size distribution, and pore density.

In a second embodiment, the polymeric material comprises a first region and a second region adjacent to the first region, wherein the first region is non-porous and the second region has an average pore size of about 50 μm or less. In some embodiments, the second region preferably has an average pore size of about 40 μm or less (e.g., about 30 μm or less). In other embodiments, the second region preferably has an average pore size of about 1 μm to about 20 μm (e.g., about 1 μm to about 15 μm, or about 1 μm to about 10 μm).

The second region can have any suitable void volume, pore size distribution, or pore density as discussed above with respect to the second region of the polishing pad of the first embodiment. Preferably, about 75% or more of the pores in the second region have a pore size within about ±20 μm or less (e.g., about ±10 μm or less, about ±5 μm or less, or about ±2 μm or less) of the average pore size.

The polishing pad of the first and second embodiments optionally comprises a plurality of first and second regions. The plurality of first and second regions can be randomly situated across the surface of the polishing pad or can be situated in an alternating pattern. For example, the first and second regions may be in the form of alternating lines, arcs, concentric circles, XY crosshatch, spirals, or other patterns typically used in connection with grooves. Polishing pads containing patterned surfaces of regions having different void volumes are expected to have increased polishing pad life compared to polishing pads patterned with conventional grooves.

The polishing pad of the first and second embodiments optionally further comprises a third region having a third void volume. The third region can have any suitable volume, void volume, average pore size, pore size distribution, or pore density as discussed above with respect to the first and second regions. In addition, the third region can be non-porous.

The polishing pad of the first and second embodiments comprises a polymeric material. The polymeric material can comprise any suitable polymer resin. The polymeric material preferably comprises a polymer resin selected from the group consisting of thermoplastic elastomers, thermoplastic polyurethanes, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylenes, polyethyleneteraphthalates, polyimides, polyaramides, polyarylenes, polystyrenes, polymethylmethacrylates, copolymers and block copolymers thereof, and mixtures and blends thereof. Preferably, the polymer resin is thermoplastic polyurethane.

The polymer resin typically is a pre-formed polymer resin; however, the polymer resin also can be formed in situ according to any suitable method, many of which are known in the art (see, for example, *Szycher's Handbook of Polyurethanes* CRC Press: New York, 1999, Chapter 3). For example, thermoplastic polyurethane can be formed in situ by reaction of urethane prepolymers, such as isocyanate, di-isocyanate, and tri-isocyanate prepolymers, with a prepolymer containing an isocyanate reactive moiety. Suitable isocyanate reactive moieties include amines and polyols.

The selection of the polymer resin will depend, in part, on the rheology of the polymer resin. Rheology is the flow behavior of a polymer melt. For Newtonian fluids, the viscosity is a constant defined by the ratio between the shear stress (i.e., tangential stress, $\sigma$) and the shear rate (i.e., velocity gradient, $d\gamma/dt$). However, for non-Newtonian fluids, shear rate thickening (dilatent) or shear rate thinning (pseudo-plastic) may occur. In shear rate thinning cases, the viscosity decreases with increasing shear rate. It is this property that allows a polymer resin to be used in melt fabrication (e.g., extrusion, injection molding) processes. In order to identify the critical region of shear rate thinning, the rheology of the polymer resins must be determined. The rheology can be determined by a capillary technique in which the molten polymer resin is forced under a fixed pressure through a capillary of a particular length. By plotting the apparent shear rate versus viscosity at different temperatures, the relationship between the viscosity and temperature can be determined. The Rheology Processing Index (RPI) is a parameter that identifies the critical range of the polymer resin. The RPI is the ratio of the viscosity at a reference temperature to the viscosity after a change in temperature equal to 20° C. for a fixed shear rate. When the polymer resin is thermoplastic polyurethane, the RPI preferably is about 2 to about 10 (e.g., about 3 to about 8) when measured at a shear rate of about 150 l/s and a temperature of about 205° C.

Another polymer viscosity measurement is the Melt Flow Index (MFI) which records the amount of molten polymer (in grams) that is extruded from a capillary at a given temperature and pressure over a fixed amount of time. For example, when the polymer resin is thermoplastic polyurethane or polyurethane copolymer (e.g., a polycarbonate silicone-based copolymer, a polyurethane fluorine-based copolymers, or a polyurethane siloxane-segmented copolymer), the MFI preferably is about 20 or less (e.g., about 15 or less) over 10 minutes at a temperature of 210° C. and a load of 2160 g. When the polymer resin is an elastomeric polyolefin or a polyolefin copolymer (e.g., a copolymer comprising an ethylene α-olefin such as elastomeric or normal ethylene-propylene, ethylene-hexene, ethylene-octene, and the like, an elastomeric ethylene copolymer made from metallocene based catalysts, or a polypropylene-styrene copolymer), the MFI preferably is about 5 or less (e.g., about 4 or less) over 10 minutes at a temperature of 210° C. and a load of 2160 g. When the polymer resin is a nylon or polycarbonate, the MFI preferably is about 8 or less (e.g., about 5 or less) over 10 minutes at a temperature of 210° C. and a load of 2160 g.

The rheology of the polymer resin can depend on the molecular weight, polydispersity index (PDI), the degree of long-chain branching or cross-linking, glass transition temperature ($T_g$), and melt temperature ($T_m$) of the polymer resin. When the polymer resin is a thermoplastic polyurethane or a thermoplastic polyurethane copolymer (such as described above), the weight average molecular weight ($M_w$) is typically about 50,000 g/mol to about 300,000 g/mol, preferably about 70,000 g/mol to about 150,000 g/mol, with a PDI of about 1.1 to about 6, preferably about 2 to about 4. Typically, the thermoplastic polyurethane or polyurethane copolymer has a glass transition temperature of about 20° C. to about 110° C. and a melt transition temperature of about 120° C. to about 250° C. When the polymer resin is an elastomeric polyolefin or a polyolefin copolymer (such as described above), the weight average molecular weight ($M_w$) typically is about 50,000 g/mol to about 400,000 g/mol, preferably about 70,000 g/mol to about 300,000 g/mol, with a PDI of about 1.1 to about 12, preferably about 2 to about 10. When the polymer resin is nylon or polycarbonate, the weight average molecular weight ($M_w$) typically is about 50,000 g/mol to about 150,000 g/mol, preferably about 70,000 g/mol to about 100,000 g/mol, with a PDI of about 1.1 to about 5, preferably about 2 to about 4.

The polymer resin preferably has certain mechanical properties. For example, when the polymer resin is a thermoplastic polyurethane, the Flexural Modulus (ASTM D790) preferably is about 200 MPa (~30,000 psi) to about 1200 MPa (175,000 psi) at 30° C. (e.g., about 350 MPa (∞50,000 psi) to about 1000 MPa (~150,000 psi) at 30° C.), the average % compressibility is about 7 or less, the average % rebound is about 35 or greater, and/or the Shore D hardness (ASTM D2240-95) is about 40 to about 90 (e.g., about 50 to about 80).

The polymeric material optionally further comprises a water absorbent polymer. The water absorbent polymer desirably is selected from the group consisting of amorphous, crystalline, or cross-linked polyacrylamide, polyacrylic acid, polyvinylalcohol, salts thereof, and combinations thereof. Preferably, the water absorbent polymers are selected from the group consisting of cross-linked polyacrylamide, cross-linked polyacrylic acid, cross-linked polyvinylalcohol, and mixtures thereof. Such cross-linked polymers desirably are water-absorbent but will not melt or dissolve in common organic solvents. Rather, the water-absorbent polymers swell upon contact with water (e.g., the liquid carrier of a polishing composition).

The polymeric material optionally contains particles that are incorporated into the body of the pad. Preferably, the particles are dispersed throughout the polymeric material. The particles can be abrasive particles, polymer particles, composite particles (e.g., encapsulated particles), organic particles, inorganic particles, clarifying particles, and mixtures thereof.

The abrasive particles can be of any suitable material. For example, the abrasive particles can comprise a metal oxide, such as a metal oxide selected from the group consisting of silica, alumina, ceria, zirconia, chromia, iron oxide, and combinations thereof, or a silicon carbide, boron nitride, diamond, garnet, or ceramic abrasive material. The abrasive particles can be hybrids of metal oxides and ceramics or hybrids of inorganic and organic materials. The particles also can be polymer particles, many of which are described in U.S. Pat. No. 5,314,512, such as polystyrene particles, polymethylmethacrylate particles, liquid crystalline polymers (LCP, e.g., Vectra® polymers from Ciba Geigy), polyetheretherketones (PEEK's), particulate thermoplastic polymers (e.g., particulate thermoplastic polyurethane), particulate cross-linked polymers (e.g., particulate cross-linked polyurethane or polyepoxide), or a combination thereof Desirably, the polymer particle has a melting point that is higher than the melting point of the polymeric material. The composite particles can be any suitable particle containing a core and an outer coating. For example, the composite particles can contain a solid core (e.g., a metal oxide, metal, ceramic, or polymer) and a polymeric shell (e.g., polyurethane, nylon, or polyethylene). The clarifying particles can be phyllosilicates, (e.g., micas such as fluorinated micas, and clays such as talc, kaolinite, montmorillonite, hectorite), glass fibers, glass beads, diamond particles, carbon fibers, and the like.

The polymeric material optionally contains soluble particles incorporated into the body of the pad. Preferably, the soluble particles are dispersed throughout the polymeric material. Such soluble particles partially or completely dissolve in the liquid carrier of the polishing composition during chemical-mechanical polishing. Typically, the soluble particles are water-soluble particles. For example, the soluble particles can be any suitable water-soluble particles, such as particles of materials selected from the group consisting of dextrins, cyclodextrins, mannitol, lactose, hydroxypropylcelluloses, methylcelluloses, starches, proteins, amorphous non-cross-linked polyvinyl alcohol, amorphous non-cross-linked polyvinyl pyrrolidone, polyacrylic acid, polyethylene oxide, water-soluble photosensitive resins, sulfonated polyisoprene, and sulfonated polyisoprene copolymer. The soluble particles also can be inorganic water-soluble particles, such as particles of materials selected from the group consisting of potassium acetate, potassium nitrate, potassium carbonate, potassium bicarbonate, potassium chloride, potassium bromide, potassium phosphate, magnesium nitrate, calcium carbonate, and sodium benzoate. When the soluble particles dissolve, the polishing pad can be left with open pores corresponding to the size of the soluble particles.

The particles preferably are blended with the polymer resin before being formed into a polishing substrate. The particles that are incorporated into the polishing pad can be of any suitable dimension (e.g., diameter, length, or width) or shape (e.g., spherical, oblong) and can be incorporated into the polishing pad in any suitable amount. For example, the particles can have a particle dimension (e.g., diameter, length, or width) of about 1 nm or more and/or about 2 mm or less (e.g., about 0.5 μm to about 2 mm diameter). Preferably, the particles have a dimension of about 10 nm or more and/or about 500 μm or less (e.g., about 100 nm to about 10 μm diameter). The particles also can be covalently bound to the polymeric material.

The polymeric material optionally contains solid catalysts that are incorporated into the body of the pad. Preferably, the solid catalysts are dispersed throughout the polymeric material. The catalyst can be metallic, non-metallic, or a combination thereof. Preferably, the catalyst is chosen from metal compounds that have multiple oxidation states, such as, but not limited to, metal compounds comprising Ag, Co, Ce, Cr, Cu, Fe, Mo, Mn, Nb, Ni, Os, Pd, Ru, Sn, Ti, and V.

The polymeric material optionally contains chelating agents or oxidizing agents. Preferably, the chelating agents and oxidizing agents are dispersed throughout the polymeric material. The chelating agents can be any suitable chelating agents. For example, the chelating agents can be carboxylic acids, dicarboxylic acids, phosphonic acids, polymeric chelating agents, salts thereof, and the like. The oxidizing agents can be oxidizing salts or oxidizing metal complexes including iron salts, aluminum salts, peroxides, chlorates, perchlorates, permanganates, persulfates, and the like.

The polishing pads described herein optionally further comprise one or more apertures, transparent regions, or translucent regions (e.g., windows as described in U.S. Pat. No. 5,893,796). The inclusion of such apertures or translucent regions is desirable when the polishing pad is to be used in conjunction with an in situ CMP process monitoring technique. The aperture can have any suitable shape and may be used in combination with drainage channels for minimizing or eliminating excess polishing composition on the polishing surface. The translucent region or window can be any suitable window, many of which are known in the art. For example, the translucent region can comprise a glass or polymer-based plug that is inserted in an aperture of the polishing pad or may comprise the same polymeric material used in the remainder of the polishing pad.

In a third embodiment, the polymeric material comprises (a) an optically transmissive region, (b) a first porous region, and optionally (c) a second porous region, wherein at least two regions selected from the optically transmissive region, first porous region, and second porous region, if present, have the same polymer formulation and have a transition that does not include a structurally distinct boundary. In one preferred embodiment, the optically transmissive region and first porous region have the same polymer formulation, and the transition between the optically transmissive region and first porous region does not include a structurally distinct boundary. In another preferred embodiment, the polymeric material further comprises a second porous region, the first and second region have the same polymer formulation, and the transition between the first and second region does not include a structurally distinct boundary. The first region and second region (when present) can have any suitable volume, void volume, average pore size, pore size distribution, and pore density as described above with respect to the first and second embodiments. In addition, the polymeric material can comprise any of the materials described above.

The optically transmissive region typically has a light transmittance of about 10% or more (e.g., about 20% or more, or about 30% or more) at one or more wavelengths between from about 190 nm to about 10,000 nm (e.g., about 190 nm to about 3500 nm, about 200 nm to about 1000 nm, or about 200 nm to about 780 nm).

The void volume of the optically transmissive region will be limited by the requirement for optical transmissivity. Preferably, the optically transmissive region is substantially non-porous or has void volume of about 5% or less (e.g., about 3% or less). Similarly, the average pore size of the optically transmissive region is limited by the requirement for optical transmissivity. Preferably, the optically transmissive region has an average pore size of about 0.01 μm to about 1 μm. Preferably, the average pore size is about 0.05 μm to about 0.9 μm (e.g., about 0.1 μm to about 0.8 μm). While not wishing to be bound to any particular theory, it is believed that pore sizes greater than about 1 μm will scatter incident radiation, while pore size less than about 1 μm will scatter less incident radiation, or will not scatter the incident radiation at all, thereby providing the optically transmissive region with a desirable degree of transparency.

Preferably, the optically transmissive region has a highly uniform distribution of pore sizes. Typically, about 75% or more (e.g., about 80% or more, or about 85% or more) of the pores in the optically transmissive region have a pore size distribution of about ±0.5 μm or less (e.g., about ±0.3 μm or less, or about ±0.2 μm or less) of the average pore size. Preferably, about 90% or more (e.g., about 93% or more, or about 95% or more) of the pores in the optically transmissive region have a pore size distribution of about ±0.5 μm or less (e.g., about ±0.3 μm or less, or about ±0.2 μm or less) of the average pore size.

The optically transmissive region can have any suitable dimensions (i.e., length, width, and thickness) and any suitable shape (e.g., can be round, oval, square, rectangular, triangular, and so on). The optically transmissive region can be flush with the polishing surface of the polishing pad, or can be recessed from the polishing surface of the polishing pad. Preferably, the optically transmissive region is recessed from the surface of the polishing pad.

The optically transmissive region optionally further comprises a dye, which enables the polishing pad material to selectively transmit light of a particular wavelength(s). The dye acts to filter out undesired wavelengths of light (e.g., background light) and thus improves the signal to noise ratio of detection. The optically transmissive region can comprise any suitable dye or may comprise a combination of dyes. Suitable dyes include polymethine dyes, di- and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 633 nm, the dye preferably is a red dye, which is capable of transmitting light having a wavelength of about 633 nm.

The polishing pads described herein can have any suitable dimensions. Typically, the polishing pad will be circular in shape (as is used in rotary polishing tools) or will be produced as a looped linear belt (as is used in linear polishing tools).

The polishing pads described herein have a polishing surface which optionally further comprises grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad comprises at least small grooves produced by standard pad conditioning methods.

The polishing pads of the invention can be produced using any suitable technique, many of which are known in the art. Preferably, the polishing pads are produced by a pressurized gas injection method comprising (i) providing a polishing pad material comprising a polymer resin and having a first void volume, (ii) subjecting the polishing pad material to a supercritical gas at an elevated pressure, and (iii) selectively foaming one or more portions of the polishing pad material by increasing the temperature of the polishing pad material to a temperature above the glass transition temperature ($T_g$) of the polishing pad material, wherein the selected portions of the polishing pad material have a second void volume that is greater than the first void volume.

More preferably, the polishing pads are produced by a pressurized gas injection method comprising (i) providing a polishing pad material comprising a polymer resin and having a first void volume, (ii) covering one or more portions of the polishing pad material with a secondary material having a desired shape or pattern, (iii) subjecting the polishing pad material to a supercritical gas at an elevated pressure, (iv) foaming the uncovered portions of the polishing pad material by subjecting the polishing pad material to a temperature above the glass transition temperature ($T_g$) of the polishing pad material, and (v) removing the secondary material so as to reveal the covered portions, wherein the uncovered portions of the polishing pad material have a second void volume that is greater than the first void volume.

Preferably, the polishing pad material is placed at room temperature into a pressure vessel. The supercritical gas is added to the vessel, and the vessel is pressurized to a level sufficient to force an appropriate amount of the gas into the free volume of the polishing pad material. The amount of gas dissolved in the polishing pad material is directly proportional to the applied pressure according to Henry's law. The pressure applied will depend on the type of polymeric material present in the polishing pad material and the type of supercritical gas. Increasing the temperature of the polishing pad material increases the rate of diffusion of the gas into the polymeric material, but also decreases the amount of gas that can dissolve in the polishing pad material. Once the gas has sufficiently (e.g., thoroughly) saturated the polishing pad material, the polishing pad material is removed from the pressurized vessel. If desired, the polishing pad material can be quickly heated to a softened or molten state to promote cell nucleation and growth. The temperature of the polishing pad material can be increased using any suitable technique. For example, the selected portions of the polishing pad can be subjected to heat, light, or ultrasonic energy. U.S. Pat. Nos. 5,182,307 and 5,684,055 describe these and additional features of the pressurized gas injection process.

The polymer resin can be any of the polymer resins described above. The supercritical gas can be any suitable gas having sufficient solubility in the polymeric material. Preferably, the gas is nitrogen, carbon dioxide, or a combination thereof. More preferably, the gas comprises, or is, carbon dioxide. Desirably, the supercritical gas has a solubility of at least about 0.1 mg/g (e.g., about 1 mg/g, or about 10 mg/g) in the polymeric material under the conditions.

The temperature and pressure can be any suitable temperature and pressure. The optimal temperature and pressure will depend on the gas being used. The foaming temperature will depend, at least in part, on the $T_g$ of the polishing pad material. Typically, the foaming temperature is above the $T_g$ of the polishing pad material. For example, the foaming temperature preferably is between the $T_g$ and the melting temperature ($T_m$) of the polishing pad material, although a foaming temperature that is above the $T_m$ of the polymeric material also can be used. Typically, the supercritical gas absorption step is conducted at a temperature of about 20° C. to about 300° C. (e.g., about 150° C. to about 250° C.) and a pressure of about 1 MPa (~150 psi) to about 40 MPa (~6000 psi) (e.g., about 5 MPa (~800 psi) to about 35 MPa (~5000 psi), or about 19 MPa (~2800 psi) to about 26 MPa (~3800 psi)).

The secondary material can comprise any suitable material. For example, the secondary material can comprise a polymeric material, a metallic material, a ceramic material, or a combination thereof. The secondary material can have any suitable shape. In some embodiments, the secondary material preferably is in the shape of one or more concentric circles or an XY crosshatch pattern. In other embodiments, the secondary material preferably is in a shape having dimensions suitable for an optical endpoint detection port.

The polishing pads described herein can be used alone or optionally can be used as one layer of a multi-layer stacked polishing pad. For example, the polishing pads can be used in combination with a subpad. The subpad can be any suitable subpad. Suitable subpads include polyurethane foam subpads (e.g., foam subpads from Rogers Corporation), impregnated felt subpads, microporous polyurethane subpads, or sintered urethane subpads. The subpad typically is softer than the polishing pad of the invention and therefore is more compressible and has a lower Shore hardness value than the polishing pad of the invention. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, apertures, and the like. When the polishing pads of the invention are used in combination with a subpad, typically there is an intermediate backing layer, such as a polyethyleneterephthalate film, coextensive with and in between the polishing pad and the subpad. Alternatively, the polishing pad of the invention can be used as a subpad in conjunction with a conventional polishing pad.

The polishing pads of the invention are particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a substrate to be polished by contacting and moving relative to the surface of the polishing pad intended to contact a substrate to be polished. The polishing of the substrate takes place by the substrate being placed in contact with the polishing pad and then the polishing pad moving relative to the substrate, typically with a polishing composition therebetween, so as to abrade at least a portion of the substrate to polish the substrate. The CMP apparatus can be any suitable CMP apparatus, many of which are known in the art. The polishing pad of the invention also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927, and U.S. Pat. No. 5,964,643. Desirably, the inspection or monitoring of the progress of the polishing process with respect to a workpiece being polished enables the determination of the polishing end-point, i.e., the determination of when to terminate the polishing process with respect to a particular workpiece.

The polishing pads described herein are suitable for use in polishing many types of substrates and substrate materials. For example, the polishing pads can be used to polish a variety of substrates including memory storage devices, semiconductor substrates, and glass substrates. Suitable substrates for polishing with the polishing pads include memory disks, rigid disks, magnetic heads, MEMS devices, semiconductor wafers, field emission displays, and other microelectronic substrates, especially substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A polishing pad for chemical-mechanical polishing comprising a pad body comprising a porous polymeric material, the pad body having at least one first region and at least one second region adjacent to the at least one first region, the pad body including pores having a first void volume in the at least one first region and pores having a second void volume in the at least one second region, wherein the pores in the at least one first region have a void volume of about 5% to about 50%, and the pores in the at least one second region have a void volume of about 20% to about 80%, and wherein the at least one first region or the at least one second region comprises about 5% or more closed cells, and wherein:

(a) the first void volume and second void volume are nonzero, (b) the first void volume is less than the second void volume, (c) the porous polymeric material in the at least one first region and the at least one second region has the same polymer formulation, (d) the pad body does not have a structurally distinct boundary between the at least one first region and the at least one second region, and (e) the pores in the at least one first region or the at least second region have a multi-modal pore size distribution, wherein the multi-modal distribution has about 20 or fewer pore size maxima.

2. The polishing pad of claim 1, wherein the pores in the at least one first region or the at least second region have an average pore size of about 50 μm or less.

3. The polishing pad of claim 2, wherein about 75% or more of the pores in the at least one first region or the at least second region have a pore size within about 20 μm or less of the average pore size.

4. The polishing pad of claim 2, wherein the pores in the at least one first region or the at least second region have an average pore size of about 1 μm to about 20 μm.

5. The polishing pad of claim 4, wherein about 90% or more of the pores in the at least one first region or the at least second region have a pore size within about 20 μm or less of the average pore size.

6. The polishing pad of claim 4, wherein about 75% or more of the pores in the at least one first region have a pore size within about 20 μm or less of the average pore size and wherein about 50% or less of the pores in the at least one second region have a pore size within about 20 μm or less of the average pore size.

7. The polishing pad of claim 1, wherein the multi-modal pore size distribution is a bimodal pore size distribution.

8. The polishing pad of claim 1, wherein the at least one first region or the at least second region has a density of about 0.5 g/cm$^3$ or greater.

9. The polishing pad of claim 1, wherein the at least one first region or the at least second region comprises about 30% or more closed cells.

10. The polishing pad of claim 1, wherein the at least one first region or the at least second region has a cell density of about $10^5$ cells/cm$^3$ or greater.

11. The polishing pad of claim 1, wherein the at least one first region and the at least one second region have a different compressibility.

12. The polishing pad of claim 1, wherein the pad body has a third region including pores having a third void volume.

13. The polishing pad of claim 1, wherein the at least one first region comprises a plurality of first regions, and the at least one second region comprises a plurality of second regions.

14. The polishing pad of claim 13, wherein the first regions and the second regions have a different compressibility.

15. The polishing pad of claim 14, wherein the first and second regions are alternating.

16. The polishing pad of claim 15, wherein the first and second regions are in the form of alternating lines or concentric circles.

17. The polishing pad of claim 1, wherein the porous polymeric material in the at least one first region and the at least one second region comprises a polymer resin selected from the group consisting of thermoplastic elastomers, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylenes, polyethyleneteraphthalates, polyimides, polyaramides, polyarylenes, polystyrenes, polymethylmethacrylates, copolymers and block copolymers thereof, and mixtures and blends thereof.

18. The polishing pad of claim 17, wherein the pad body further comprises a water absorbent polymer.

19. The polishing pad of claim 18, wherein the water absorbent polymer is selected from the group consisting of cross-linked polyacrylamide, cross-linked polyacrylic acid, cross-linked polyvinylalcohol, and combinations thereof.

20. The polishing pad of claim 17, wherein the pad body further comprises particles selected from the group consisting of abrasive particles, polymer particles, composite particles, liquid carrier-soluble particles, and combinations thereof.

21. The polishing pad of claim 20, wherein the pad body further comprises abrasive particles selected from the group consisting of silica, alumina, ceria, and combinations thereof.

22. The polishing pad of claim 1, wherein the porous polymeric material is a thermoplastic polyurethane.

23. The polishing pad of claim 22, wherein the thermoplastic polyurethane has a Melt Index of about 20 or less, a weight average molecular weight ($M_w$) of about 50,000 g/mol to about 300,000 g/mol, and a polydispersity index (PDI) of about 1.1 to about 6.

24. The polishing pad of claim 22, wherein the thermoplastic polyurethane has a Rheology Processing Index (RPI) of about 2 to about 10 at a shear rate ($\gamma$) of about 150 l/s and a temperature of about 205° C.

25. The polishing pad of claim 22, wherein the thermoplastic polyurethane has a Flexural Modulus of about 200 MPa to about 1200 MPa at 30° C.

26. The polishing pad of claim 22, wherein the thermoplastic polyurethane has a glass transition temperature of about 20° C. to about 110° C. and a melt transition temperature of about 120° C. to about 250° C.

27. A method of polishing a substrate comprising:

(a) providing a substrate to be polished, (b) contacting the substrate with a polishing system comprising the polishing pad in claim 1 and a polishing composition, and (c) abrading at least a portion of the substrate with the polishing system to polish the substrate.

28. A method of producing the polishing pad of claim 1 comprising:

providing a polishing pad material comprising a polymer resin and including pores having a first void volume, subjecting the polishing pad material to a supercritical gas at an elevated pressure, and selectively foaming one or more portions of the polishing pad material by increasing the temperature of the polishing pad material to a temperature above the glass transition temperature ($T_g$) of the polishing pad material, wherein the selected portions of the polishing pad material include pores having a second void volume that is greater than the first void volume.

29. The method of claim 28, wherein the gas does not contain C—H bonds.

30. The method of claim 29, wherein the gas comprises nitrogen, carbon dioxide, or combinations thereof.

31. The method of claim 30, wherein the gas is carbon dioxide, the temperature is about 0° C. to about the melting temperature of the polymer resin, and the pressure is about 1 MPa to about 35 MPa.

32. The method of claim 28, wherein the polymer resin is selected from the group consisting of thermoplastic elastomers, thermoplastic polyurethanes, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylenes, polyethyleneteraphthalates, polyimides, polyaramides, polyarylenes, polystyrenes, polymethylmethacrylates, copolymers and block copolymers thereof, and mixtures and blends thereof.

33. The method of claim 28, wherein the polymer resin is a thermoplastic polyurethane.

34. The method of claim 28, wherein the foaming comprises covering one or more portions of the polishing pad material with a secondary material and foaming uncovered portions of the polishing pad material, and the secondary material is in the shape of one or more concentric circles.

35. The method of claim 28, wherein the foaming comprises covering one or more portions of the polishing pad material with a secondary material and foaming uncovered portions of the polishing pad material, and the secondary material is in the shape of an XY crosshatch pattern.

36. The method of claim 28, wherein the foaming comprises covering one or more portions of the polishing pad material with a secondary material and foaming uncovered portions of the polishing pad material, and the secondary material has dimensions suitable for an optical endpoint detection port.

37. The method of claim 28, wherein the regions of the polishing pad are selectively foamed by covering one or more selected portions of the polishing pad material with a secondary material having a desired shape or pattern, foaming uncovered portions of the polishing pad material, and removing the secondary material so as to reveal the selected portions.

* * * * *